US008818779B2

(12) United States Patent
Sadlier et al.

(10) Patent No.: US 8,818,779 B2
(45) Date of Patent: Aug. 26, 2014

(54) SYSTEM AND METHODS FOR REAL-TIME WELLBORE STABILITY SERVICE

(75) Inventors: Andreas G. Sadlier, The Woodlands, TX (US); James Peter Dwyer, Conroe, TX (US); Martin O. Brudy, Houston, TX (US); Christopher A. Wolfe, Katy, TX (US); Michael M. Reese, Youngsville, LA (US)

(73) Assignee: Baker Hughes Incorporated, Houston, TX (US)

( * ) Notice: Subject to any disclaimer, the term of this patent is extended or adjusted under 35 U.S.C. 154(b) by 434 days.

(21) Appl. No.: 12/974,759

(22) Filed: Dec. 21, 2010

(65) Prior Publication Data

US 2011/0153296 A1 Jun. 23, 2011

Related U.S. Application Data

(60) Provisional application No. 61/288,662, filed on Dec. 21, 2009.

(51) Int. Cl.
*G06G 7/48* (2006.01)

(52) U.S. Cl.
USPC ..... 703/10; 703/7; 702/6; 175/24; 175/57

(58) Field of Classification Search
USPC ..... 703/7, 10
See application file for complete search history.

(56) References Cited

U.S. PATENT DOCUMENTS

| | | | | |
|---|---|---|---|---|
| RE35,386 | E | 12/1996 | Wu et al. | |
| 5,767,399 | A * | 6/1998 | Smith et al. | 73/152.11 |
| 6,021,377 | A | 2/2000 | Dubinsky et al. | |
| 6,179,069 | B1 * | 1/2001 | Zheng | 175/65 |
| 6,438,495 | B1 * | 8/2002 | Chau et al. | 702/9 |
| 7,063,174 | B2 | 6/2006 | Chemali et al. | |
| 7,167,006 | B2 | 1/2007 | Itskovich | |
| 7,181,380 | B2 * | 2/2007 | Dusterhoft et al. | 703/10 |
| 7,261,167 | B2 * | 8/2007 | Goldman et al. | 175/39 |
| 7,349,807 | B2 | 3/2008 | Moos et al. | |
| 7,434,632 | B2 * | 10/2008 | Chen et al. | 175/57 |
| 7,612,566 | B2 | 11/2009 | Merchant et al. | |
| 7,831,419 | B2 * | 11/2010 | Cariveau et al. | 703/7 |
| 7,953,587 | B2 * | 5/2011 | Bratton et al. | 703/10 |
| 8,190,369 | B2 * | 5/2012 | Moos et al. | 702/9 |
| 8,214,188 | B2 * | 7/2012 | Bailey et al. | 703/10 |
| 8,280,709 | B2 * | 10/2012 | Koutsabeloulis et al. | 703/10 |
| 2006/0212224 | A1 | 9/2006 | Jogi et al. | |

(Continued)

OTHER PUBLICATIONS

Bradford et al, "When Rock Mechanics Met Drilling: Effective Implementation of Real-Time Wellbore Stability Control", IADC/SPE 59121, Feb. 23-25, 2000.*

(Continued)

*Primary Examiner* — Mary C Jacob
(74) *Attorney, Agent, or Firm* — Cantor Colburn LLP

(57) ABSTRACT

Apparatus and method of conducting a drilling operation are provided. One embodiment of the method includes drilling a borehole, predicting a value of a first parameter relating to the drilling of the borehole using a geomechanical model, estimating a value of a second parameter from measurements taken by a sensor, updating the geomechanical model based at least in part on the estimated value of the second parameter, predicting a second value of the first parameter using the updated geomechanical model, and altering a drilling parameter for drilling the borehole based on the predicted second value of the first parameter.

21 Claims, 7 Drawing Sheets

(56) References Cited

U.S. PATENT DOCUMENTS

| | | | | |
|---|---|---|---|---|
| 2007/0199721 | A1* | 8/2007 | Givens et al. | 166/382 |
| 2009/0065252 | A1 | 3/2009 | Moos et al. | |
| 2009/0173150 | A1 | 7/2009 | DiFoggio et al. | |
| 2010/0243328 | A1* | 9/2010 | Rodriguez Herrera | 175/61 |
| 2010/0324825 | A1* | 12/2010 | Detournay | 702/6 |

OTHER PUBLICATIONS

Bratton et al, "Avoiding Drilling Problems", Oilfield Review, Summer 2001, pp. 33-51.*

Aldred et al, "Managing Drilling Risk", Oilfield Review, Summer 1999, pp. 2-19.*

Zoback et al, "Determination of Stress Orientation and Magnitude in Deep Wells", International Journal of Rock Mechanics & Mining Sciences, 40, pp. 1049-1076, 2003.*

Addis et al, "The Quest for Borehole Stability in the Cusiana Field, Columbia", Oilfield Review, Apr./Jul. 1993.*

Ali et al, "Watching Rocks Change—Mechanical Earth Modeling", Oilfield Review, Summer 2003.*

Heisig, G et al., "Downhole Diagnosis of Drilling Dynamics Data Provides New Level Drilling Process Control to Driller," SPE 49206, 1998 SPE Annual Technical Conference and Exhibition, New Orleans, Louisiana, Sep. 27-30, 1998, pp. 649-658.

Horsrud, P., "Estimating Mechanical Properties of Shale From Empirical Correlations," Jun. 2001 SPE Drilling & Completion, pp. 68-73.

Tang, Lin et al., "The Effect of the Thermal Stress on Wellbore Stability," SPE 39505, 1998 SPE India Oil and Gas Conference and Exhibition, New Delhi, India, Feb. 17-19, 1998, pp. 85-94.

* cited by examiner

SYSTEM AND METHODS FOR REAL-TIME WELLBORE STABILITY SERVICE

CROSS REFERENCES TO RELATED APPLICATIONS

This application claims priority from the U.S. Provisional Patent Application having Ser. No. 61/288,662 filed Dec. 21, 2009

BACKGROUND OF THE DISCLOSURE

1. Field of the Disclosure

This disclosure relates to systems, devices and methods that reduce non-productive time (NPT), cut costs, reduce risks and increase safety margins.

2. The Related Art

A majority of wells have unnecessarily high costs due to NPT, increased uncertainty and risk, and safety related issues. Most of these excessive costs are related to poor prediction or mismanagement of wellbore pressures and/or failure to mitigate wellbore integrity ("WBI") issues in the pre-drill or drilling execution stages. The term "wellbore integrity," sometimes used synonymously with "wellbore stability" (:"WBS") refers to maintaining the wellbore during drilling from adverse effects. Some industry examples of such excessive costs include the following: 1) significant losses taken from kicks in deepwater Gulf of Mexico; 2) costs associated with running unnecessary/unplanned casing strings related to pressure instability problems; and, 3) losses experienced due to collapsed wellbores and/or inability to reach targets.

These losses occur because of the time spent addressing unplanned conditions, such as kicks, lost circulation and borehole stability problems, until drilling can again proceed. A recent global drilling study by Welling and Company identified wellbore instability related NPT (e.g., WBI, kicks, stuck pipe and lost circulation) to be as high as 36%. Another issue addressed in this study, which can be directly related to wellbore instability, is the inability to get casing or a liner to bottom. WBS/WBI-related issues (e.g., poor borehole quality, collapse, formation problems, loss circulations and shale stability) can account for a very large percent of the failures, some times in excess of 80 percent.

The present disclosure is directed towards a real-time WBI service to reduce operators' WBI-related NPT.

SUMMARY OF THE DISCLOSURE

In one aspect, a method of conducting a drilling operation is provided. In one embodiment, the method includes: drilling a borehole, predicting a value of a first parameter relating to the drilling of the wellbore using a geomechanical model, estimating a value of a second parameter from measurements taken by a sensor, updating the geomechanical model based at least in part on the estimated value of the second parameter, predicting a second value of the first parameter using the updated geomechanical model, and altering a drilling parameter for drilling the borehole based on the predicted second value of the first parameter. In another aspect, the predicted second value is obtained in real time. The term real time means when an apparatus for conducting the drilling operation is downhole.

In another aspect, an apparatus for drilling a borehole is provide. In one embodiment, the apparatus includes a bottomhole assembly configured to be conveyed into the borehole, a sensor configured to make a measurement at one of a downhole location and a surface location and a processor configured to: predict a value of a first parameter relating to the drilling of the wellbore using a Geomechanical Model; estimate a value of a second parameter from the measurement taken by the sensor; update the Geomechanical Model based at least in part on the estimated value of the second parameter; predict a second value of the first parameter using the updated Geomechanical Model; and alter a drilling parameter for drilling the borehole based on the predicted second value of the first parameter.

In yet another aspect, the disclosure provides a computer-readable medium having stored thereon instructions that when read by the processor enables processor to perform a method. In one aspect, the method includes: drilling a borehole, predicting a value of a first parameter relating to the drilling of the wellbore using a geomechanical model, estimating a value of a second parameter from measurements taken by a sensor, updating the geomechanical model based at least in part on the estimated value of the second parameter, predicting a second value of the first parameter using the updated geomechanical model, and altering a drilling parameter for drilling the borehole based on the predicted second value of the first parameter.

BRIEF DESCRIPTION OF THE DRAWINGS

For a detailed understanding of the present disclosure, reference should be made to the following detailed description, taken in conjunction with the accompanying drawing.

DETAILED DESCRIPTION OF THE DISCLOSURE

Figure 1:
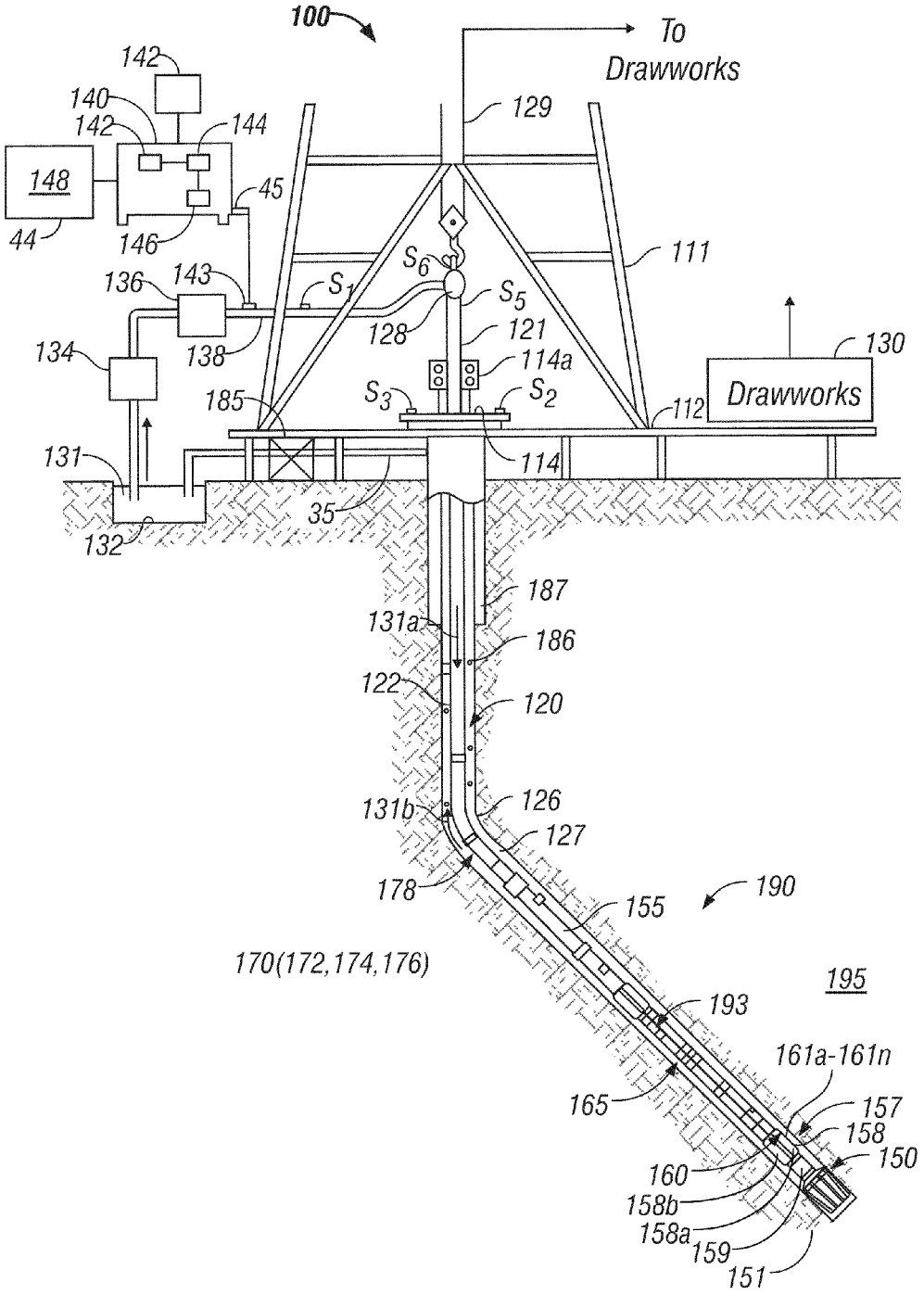
FIG. 1 is an elevation view of an exemplary drilling system suitable for use with the present disclosure.

The teachings of the present disclosure can be applied in a number of arrangements to generally improve the drilling process by using indications of the lithology of the formation being drilled. As is known, formation lithology generally refers to an earth or rock characteristic such as the nature of the mineral content, grain size, texture and color. Such improvements may include reduced drilling time and associated costs, safer drilling operations, more accurate drilling, improvement in rate of penetration ("ROP"), extended drill string life, improved bit and cutter life, reduction in wear and tear on bottomhole assembly ("BHA"), and an improvement in borehole quality. The present disclosure is susceptible to embodiments of different forms. These are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

FIG. 1 is a schematic diagram of an exemplary drilling system 100 that includes a drill string having a drilling assembly attached to its bottom end that includes a steering unit according to one embodiment of the disclosure. FIG. 1 shows a drill string 120 that includes a drilling assembly or bottom-hole assembly (BHA) 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122, having the drilling assembly 190, attached at its bottom end extends from the surface to the bottom 151 of the borehole 126. A drill bit 150, attached to drilling assembly 190, disintegrates the geological formations when it is rotated to drill the borehole 26. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. Alternatively, a coiled-tubing may be used as the tubing 122. A tubing injector 114*a* may be used to convey the coiled-tubing having the drilling assembly attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 respectively provide information about the torque and the rotational speed of the drill string 120. Tubing injection speed is determined from the sensor $S_5$, while the sensor $S_6$ provides the hook load of the drill string 120.

In some applications, the drill bit 150 is rotated by only rotating the drill pipe 122. However, in many other applications, a downhole motor 155 (mud motor) disposed in the drilling assembly 190 also rotates the drill bit 150. The ROP for a given BHA largely depends on the WOB or the thrust force on the drill bit 150 and its rotational speed.

The mud motor 155 is coupled to the drill bit 150 via a drive shaft disposed in a bearing assembly 157. The mud motor 155 rotates the drill bit 150 when the drilling fluid 131 passes through the mud motor 155 under pressure. The bearing assembly 157, in one aspect, supports the radial and axial forces of the drill bit 150, the down-thrust of the mud motor 155 and the reactive upward loading from the applied weight-on-bit.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided to the surface control unit 140. The surface control unit 140 displays desired drilling parameters and other information on a display/monitor 142 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices.

The BHA may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, formation pressures, properties or characteristics of the fluids downhole and other desired properties of the formation 195 surrounding the drilling assembly 190. Such sensors are generally known in the art and for convenience are generally denoted herein by numeral 165. The drilling assembly 190 may further include a variety of other sensors and devices 159 for determining one or more properties of the BHA (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.) For convenience, all such sensors are denoted by numeral 159.

The drilling assembly 190 includes a steering apparatus or tool 158 for steering the drill bit 150 along a desired drilling path. In one aspect, the steering apparatus may include a steering unit 160, having a number of force application members 161*a*-161*n*, wherein the steering unit is at partially integrated into the drilling motor. In another embodiment the steering apparatus may include a steering unit 158 having a bent sub and a first steering device 158*a* to orient the bent sub in the wellbore and the second steering device 158*b* to maintain the bent sub along a selected drilling direction.

The MWD system includes sensors, circuitry and processing software and algorithms for providing information about desired dynamic drilling parameters relating to the BHA, drill string, the drill bit and downhole equipment such as a drilling motor, steering unit, thrusters, etc. Exemplary sensors include, but are not limited to, drill bit sensors, an RPM sensor, a weight on bit sensor, sensors for measuring mud motor parameters (e.g., mud motor stator temperature, differential pressure across a mud motor, and fluid flow rate through a mud motor), and sensors for measuring acceleration, vibration, whirl, radial displacement, stick-slip, torque, shock, vibration, strain, stress, bending moment, bit bounce, axial thrust, friction, backward rotation, BHA buckling and radial thrust. Sensors distributed along the drill string can measure physical quantities such as drill string acceleration and strain, internal pressures in the drill string bore, external pressure in the annulus, vibration, temperature, electrical and magnetic field intensities inside the drill string, bore of the drill string, etc. Suitable systems for making dynamic downhole measurements include a system referred to a COPILOT, manufactured by Baker Hughes Incorporated, the assignee of this application. Suitable systems are also discussed in "Downhole Diagnosis of Drilling Dynamics Data Provides New Level Drilling Process Control to Driller," SPE 49206, by G. Heisig and J. D. Macpherson, 1998.

The MWD system 100 can include one or more downhole processors at a suitable location such as 193 on the BHA 190. The processor(s) can be a microprocessor that uses a computer program implemented on a suitable machine readable medium that enables the processor to perform the control and processing. The machine readable medium may include ROMs, EPROMs, EAROMs, EEPROMs, Flash Memories, RAMs, Hard Drives and/or Optical disks. Other equipment such as power and data buses, power supplies, and the like will be apparent to one skilled in the art. In one embodiment, the MWD system utilizes mud pulse telemetry to communicate data from a downhole location to the surface while drilling operations take place. The surface processor 142 can process the surface measured data, along with the data transmitted from the downhole processor, to evaluate formation lithology.

Figure 2:
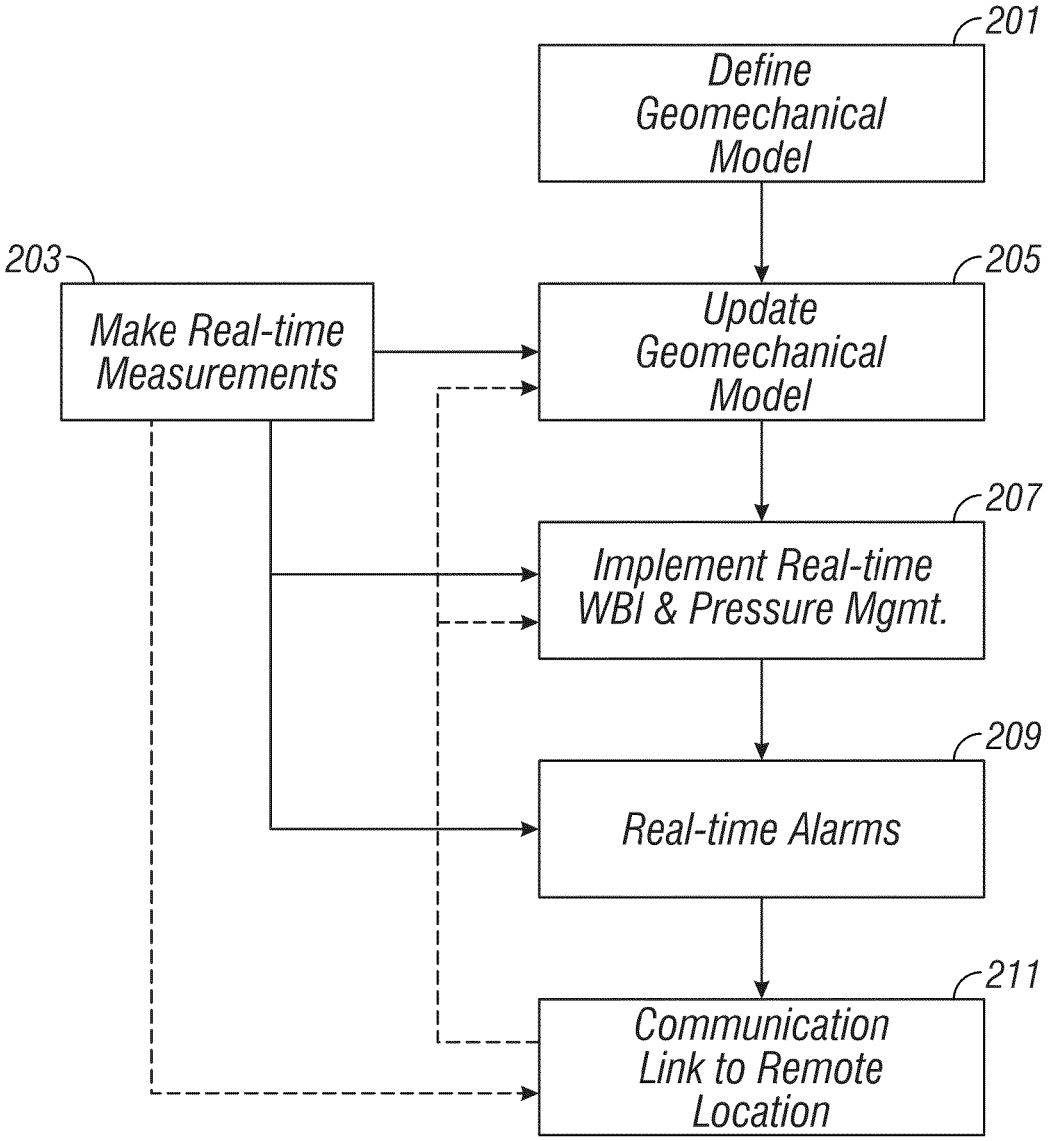
FIG. 2 is a block diagram from an exemplary flow chart of operations in a system made in accordance with the present disclosure for Wellbore Integrity Service.

Referring now to FIG. 2, there is shown in block diagram from an exemplary flow chart of operations in a system made in accordance with the present disclosure for Wellbore Integrity Service. A pre-drill "Geomechanical Model" is defined 201. For the purposes of the present disclosure, we adopt the following definition of a Geomechanical Model:

> A Geomechanical Model is an earth model that specifies the earth's stress orientations and magnitudes, the pore pressure, and the rock strength for an area of consideration.

In one embodiment of the disclosure, this is done using the method disclosed in U.S. Pat. No. 7,349,807 to Moos et al, having the same assignee as the present disclosure. As disclosed in Moos '807, pre-drill pore pressure and fracture gradient predictions obtained from seismic velocity data are used in well design taking into account uncertainties in the velocity estimation and in the models that use the velocities to determine pore pressure. Using geological constraints, limits are established on hydrocarbon column height. It is also possible to predict the relative number of casings required to reach target reservoirs. The use of the teachings of Moos '807 is not intended to be a limitation and other methods may be used.

Real-time measurements of downhole parameters predicted by the pre-drill Geomechanical Model are made 203. For the purpose of the present disclosure, we adopt the following definition of "Real-time":

> Enough time to enable the ability to compare downhole conditions with a pre-built geomechanical well bore integrity model while drilling that allow for the modification of the model to effectively and efficiently drill a well bore in an acceptable mud weight and geomechanical window and advising the operations group in trends and warnings to accomplish this.

The real-time measurements are compared to the predicted values from the Geomechanical Model and the model may be updated 205. Using the updated Geomechanical Model and the real-time measurements, a real-time WBI and Pressure Management System is implemented. Based on the real-time measurements 203 and the updated Geomechanical Model, alarms are triggered 209 when certain operating requirements are violated.

The alarms are sub-divided into "warning alarms" and "critical alarms. The warning alarm is by definition less severe and results in a yellow light indicating to proceed with extreme caution. The critical alarm, which is delineated by a red light, points out that problems are imminent and that action is required immediately. Both of these alarm types will be user configurable and the system will automatically supply some default settings. The warning alarm is triggered based on a specified threshold warning level being crossed and the critical alarm is triggered based on a threshold critical level.

A communication link is provided to a remote location 211 where operating conditions may be reviewed by a human operator. The updating of the Geomechanical Model 205 and the Real Time WBI management may be done either by an Expert System downhole or, as indicated by the dashed lines, using intervention from the remote location. We adopt the definition of an Expert System defined as given in the Encyclopedia Britannica:

> a computer program that uses artificial intelligence to solve problems within a specialized domain that ordinarily requires human expertise.

As noted further in the Encyclopedia Britannica, in order to accomplish feats of apparent intelligence, an expert system relies on two components: a knowledge base and an inference engine. A knowledge base is an organized collection of facts about the system's domain. An inference engine interprets and evaluates the facts in the knowledge base in order to provide an answer. Typical tasks for expert systems involve classification, diagnosis, monitoring, design, scheduling, and planning for specialized endeavours.

Figure 3:
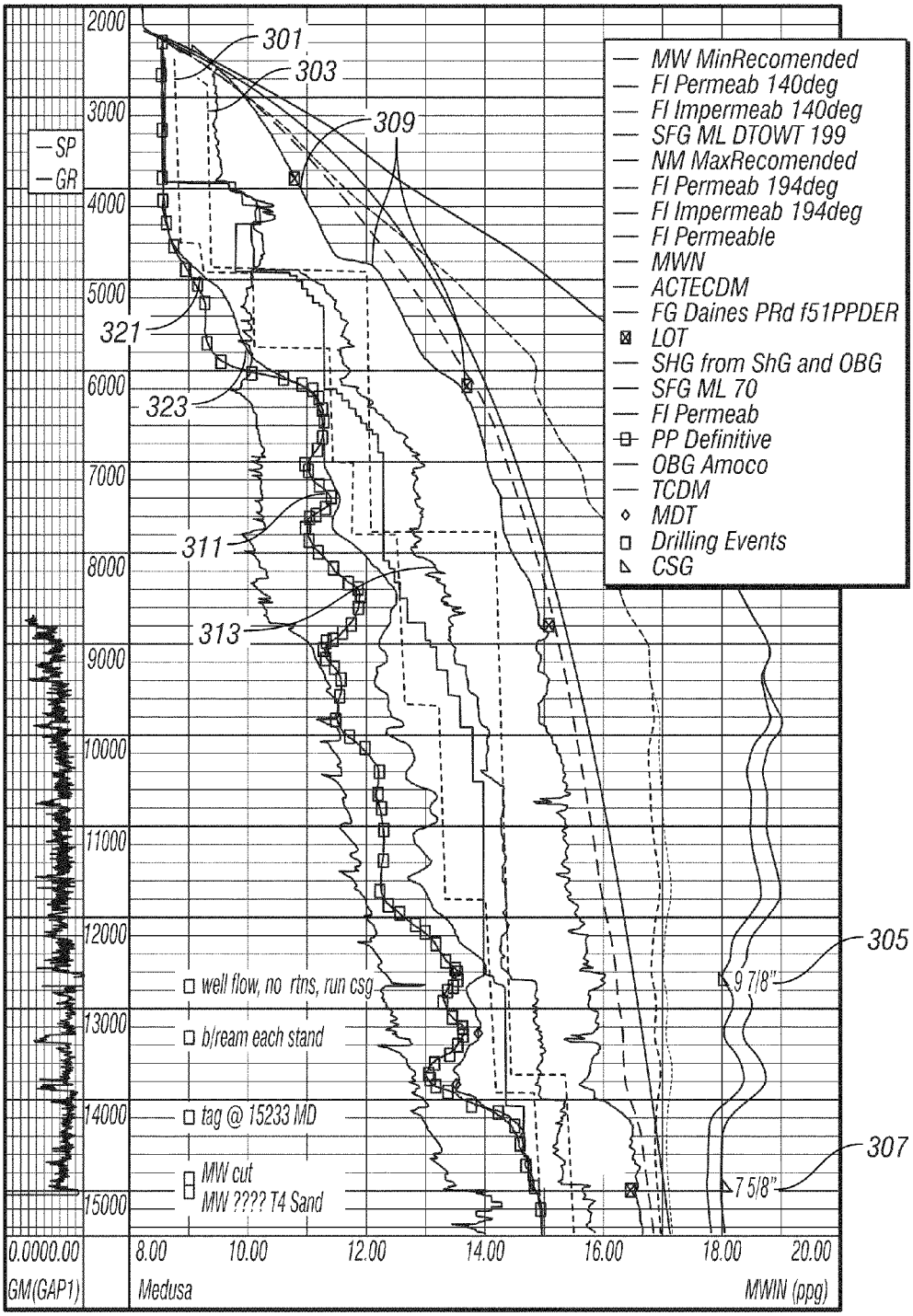
FIG. 3 shows a WBI analysis using measurements such as MWD/LWD, mud-logging, drilling events/conditions along with integration of wireline/seismic calibration into the Geomechanical Model.

FIG. 3 shows an exemplary WBI analysis using LWD measurements. The ordinate of the plot is the true vertical depth (TVD) and various parameters are plotted in the abscissa. In addition to the basic figure that shows an exemplary output of a prior art Geomechanical Model, the figure also includes an explanation of the present disclosure. Attention is drawn to the curves 301 and 303. These are the minimum and maximum mud weights recommended by the pre-drill Geomechanical Model for drilling of the borehole, and define a mud window. These recommended mud weights are a part of the output of a Geomechanical Model, as are locations 305, 307 where setting of casing is recommended.

In addition, FIG. 3 also shows measurements of the formation pore pressure 311 and the equivalent circulating density ("ECD") 313, the force exerted by the mud against the borehole wall taking into account the pressure drop in the annulus. In addition, in the present case, depths 309 where leak-off tests ("LOT") are performed for measuring formation permeability are shown. These locations are typically an optional output of a Geomechanical Model.

Figure 4:
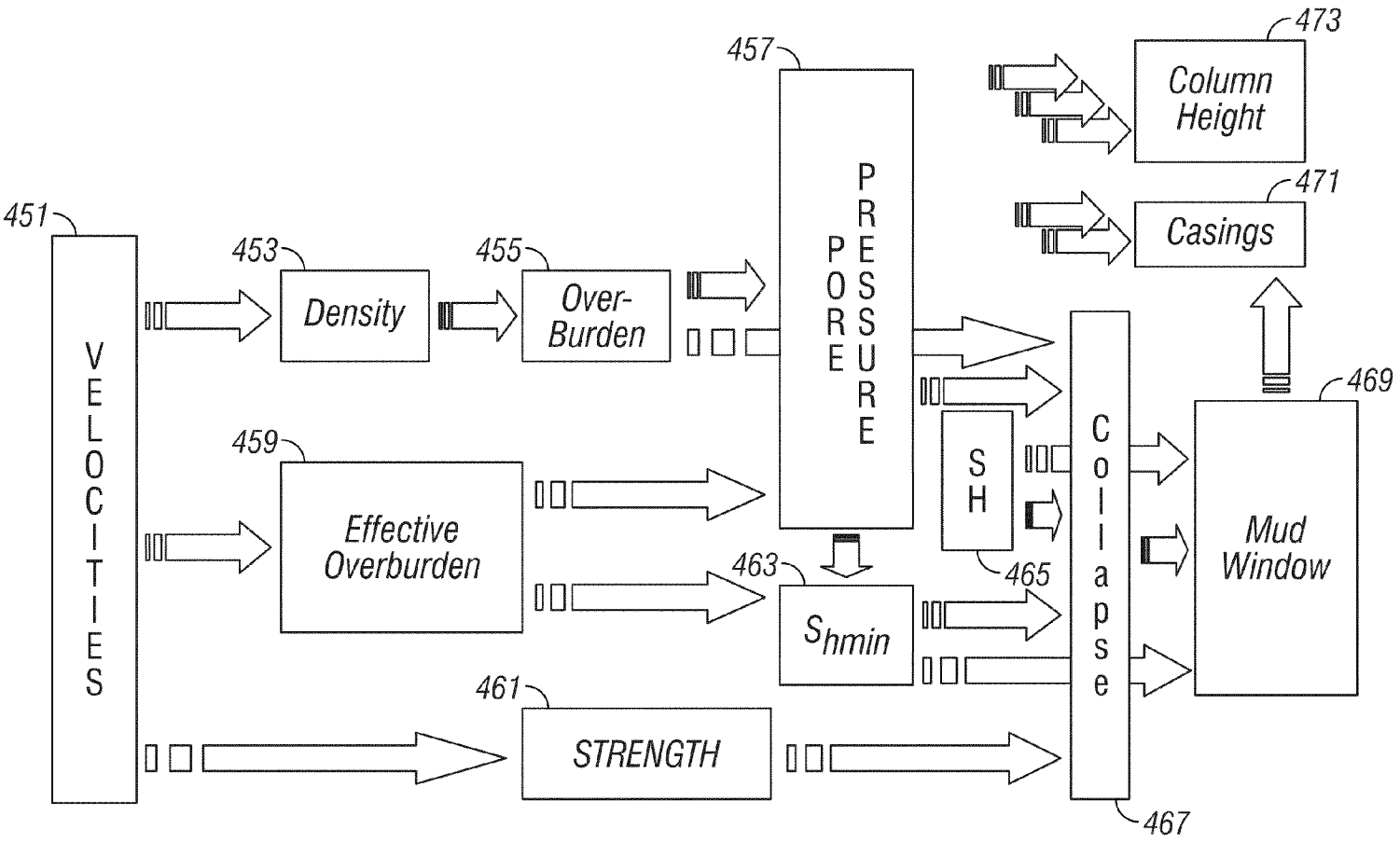
FIG. 4 (Prior Art)
FIG. 4 (prior art) is a flow chart showing steps involved in determination of a mud window using seismic velocities.

Turning next to FIG. 4, a prior art flow chart showing steps involved in the determination of a mud window using surface measurements of seismic velocities is shown. Starting with the seismic velocities 451, density 453 and effective overburden 459 are calculated as discussed in Moos '807. The density 453 is integrated to give the overburden 455 and, using the effective overburden 459, the pore pressure 457 is calculated. Rock strength is estimated 461 from velocity using prior art methods. See, for example, Horsrud, P., 2001. See, "Estimating mechanical properties of shale from empirical correlations, SPE Drilling and Completion, June, 2001, 68-73."

It should be noted that the method disclosed in Moos '807 is not to be construed as a limitation to the present disclosure. A Geomechanical Model can also be derived from well data in previously drilled wells, and methods other than those described above can be used for estimating formation pore pressures and the mud window.

An important factor in mud weight selection is the ability to maintain a finite mud window between the minimum safe effective mud weight and the maximum safe effective mud weight over the entire open hole interval. The minimum safe mud weight for the mud window 469 is determined by the pore pressure where the rock is strong and should be at a value sufficient to prevent invasion of formation fluids into the borehole and/or a blowout.

Where the rock is weak, wellbore stability is an issue, and the minimum safe mud weight should be the larger of the pore pressure 457 and the collapse pressure 467, defined as the internal wellbore pressure below which the rock around the well is so unstable that it prevents further drilling. The collapse pressure 467 is controlled by the rock strength 461, the stress magnitudes 463, 465, overburden 455 and the orientation of the well with respect to the stress field.

The upper bound on the mud window is the lost circulation pressure, which can be any one of (i) the fracture initiation pressure when there are no pre-existing fractures in the formation, (ii) the fracture link-up pressure when there are pre-existing fractures that may be linked by excessive mud pressure, and (iii) the fracture propagation pressure when there are preexisting fractures that can be opened up further by excessive mud pressure. Although the upper bound on the mud window can be increased using appropriate mud formulations, the safest assumption is that the upper bound on the mud window is limited by the least principal stress $S_{hmin}$ 463. The fracture initiation and linkup pressures are controlled by the in situ stress state and the wellbore orientation. The column height constraints 473 can be used as a first pass estimate of the volume of hydrocarbons in risk-based reservoir evaluation. As discussed in Moos '807, the column height constraint arises in an inclined, overpressured sand layer where the pressure gradient inside the sand is greatly different from the pressure gradient in the surrounding shale. The casing selection 471 is discussed further below.

Moos '807 also provides an uncertainty analysis based on uncertainties in the data used as input to the Geomechanical Model. The mud weight constraints in Moos '807 represent significant improvements over previous methods that utilized pore pressure and fracture gradient alone. The method in Moos '807 allows computation not only of mud windows for wells of any orientation (although this requires information about stress orientation in addition to all three principal stresses) but also provides quantitative estimates of the influence of uncertainties in the input velocities, on the final well design.

Figure 5:
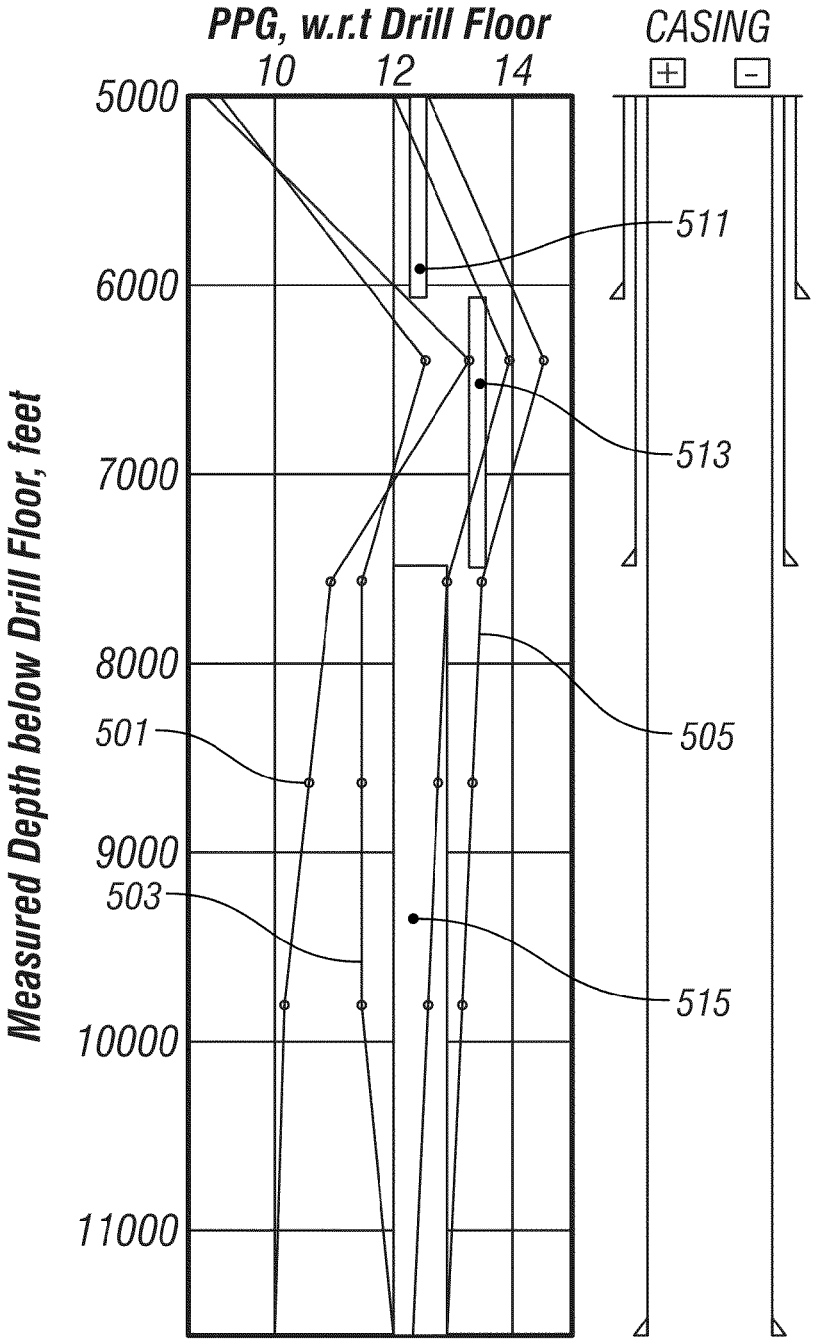
FIG. 5 (Prior Art)
FIG. 5 (prior art) shows a method for casing selection.

An example of casing design is shown in FIG. 5. Illustrated is a selected depth interval where 501 is the estimated pore pressure from seismic velocities, 503 is the collapse pressure, and 505 is the fracture gradient which cannot be exceeded. For such a situation, the casing design with casing sections 511, 513 and 515 satisfy the requirements for wellbore stability discussed above. As discussed above, the collapse pressure 503 and the fracture gradient 505 can be used to define the thresholds for the warning alarm and the critical alarm.

Referring back to FIG. 3, some examples of real-time measurements during drilling that may require an updating of the Geomechanical Model are discussed. Attention is first drawn to the depth 321 where the pre-drill Geomechanical Model indicates a significant change in the mud window. This is presumably related to a lithology change, so that a real-time measurement of this lithology change by a formation evaluation sensor would be used to update the Geomechanical Model. Also of interest would be the LOT measurement 309 of permeability just below this depth: a difference of the measured permeability from the value assumed in the Geomechanical Model may justify an updating of the model. For example, if the measured permeability is much lower than that assumed in the Geomechanical Model, it increases the likelihood of overpressuring in an underlying permeable layer A change in the mud window is also noted at 323, so that accurate identification of lithologic boundaries is important.

A change in formation pore pressure 311 is also part of the pre-drill Geomechanical Model around depth 323, suggesting a transition from a relatively impermeable formation into a permeable formation. Deviation of the measured pore pressure from the predicted formation pore pressure would suggest the need for updating the Geomechanical Model. Specifically, the model would need updating if the measured pore pressure violates the warning threshold.

During drilling operations, there are several measurements that can be made to check the integrity of the borehole. U.S. patent application Ser. No. 12/185,676 of Moos et al. (US 20090065252) having the same assignee as the present disclosure teaches the use of available a priori data regarding the stress characteristics of a region of interest to develop a preliminary stress model for the region. A geosteered drilling operation is thereafter commenced, with the trajectory being steered in a direction relative to the stress model of the region. While drilling, real-time data is obtained from conventional down-hole instrumentation. The real-time data is used to refine the stress model for the region, such that the trajectory can be guided on an ongoing basis to achieve an optimal relationship with the estimated directions of principal stresses. Among the teachings of Moos '252 is the use of caliper data to estimate the shape of the borehole and identify breakouts. The direction of the maximum principal stress can be inferred from the azimuth of the breakouts and/or the azimuth of the tensile fractures. The determined direction may then be used to control the direction of drilling. A point of novelty of the present disclosure is that the drilling direction may be controlled using an updated Geomechanical Model. In the absence of active control of the drilling direction, the drillbit would have a tendency to drift in the direction of a minimum horizontal principal stress.

Figure 6A:
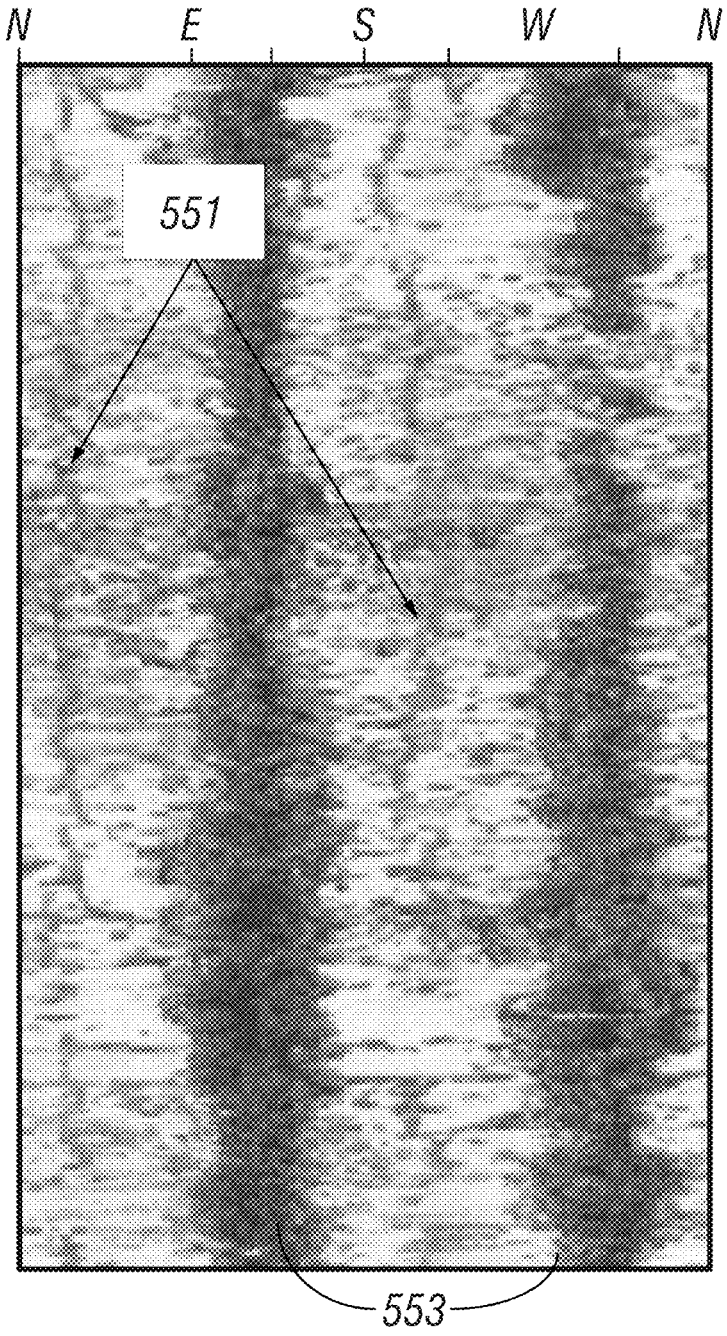
FIG. 6A (Prior Art)
FIG. 6A (prior art) shows an exemplary acoustic image of a borehole wall.

In addition to or as an alternative to the use of borehole geometry, one embodiment of the disclosure uses a borehole image to identify the principal stress directions. FIG. 6A shows an exemplary acoustic image of a borehole wall. The vertical axis is depth, and the horizontal axis is the circumference of the borehole wall unfolded onto a plane. In this particular example, the center of the image corresponds to South. The tensile fractures 551 can be seen in the image. The tensile fractures are oriented 90° from the breakouts 553. It is worth noting that the breakouts are characterized by a weaker signal (darker color) than the rest of the image, indicating a smaller acoustic contrast with the borehole fluid. Detailed analysis of the breakouts is discussed next.

Figure 6B:
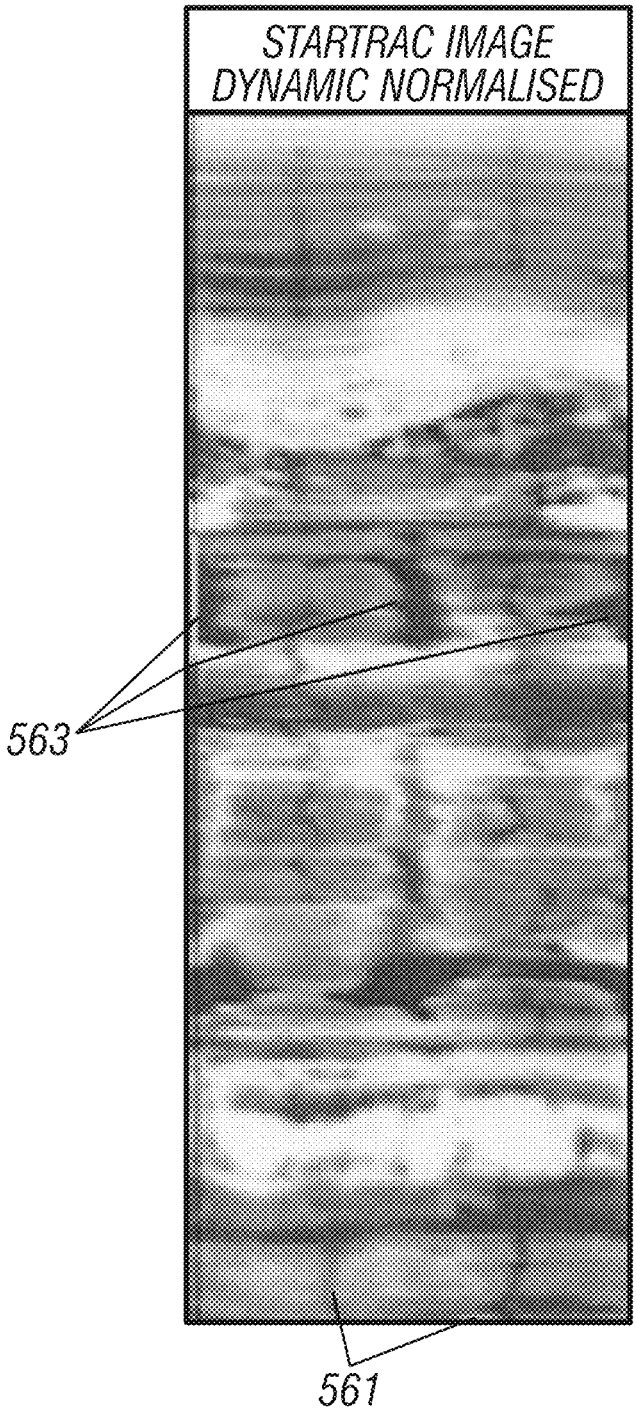
FIG. 6B (Prior Art)
FIG. 6B (prior art) shows a resistivity image of a borehole wall.

Breakouts and tensile fractures (also referred to as drilling-induced fractures) can also be seen on other images of the borehole wall. For example, FIG. 6B shows a resistivity image of a borehole wall. Such a resistivity image is obtained by using a microresistivity imaging tool. Tensile fractures are indicated by 561 while breakouts are indicated by 563. Thus, resistivity images may be used to identify the directions of the principal stress. The identification of principal stress directions may be done in real-time by the downhole processor, or the image may be telemetered uphole for interpretation by a human. It should be noted that other types of images, such as density images, also show breakouts and tensile fractures and can thus be used to identify the directions of principal stress. The occurrence of drilling induced fractures is an indication to reduce the mud weight and may be used to trigger a warning alarm apart from measurements of formation pore pressure or the ECD. The caliper measurements and the imaging measurements may be made in real-time to provide real-time WBI and pressure management. See 207 in FIG. 2. Referring now in more detail to FIG. 2, examples of measurements that could trigger an alarm are discussed.

In one embodiment of the disclosure, the pre-drill Geomechanical Model also includes a planned trajectory for the borehole. U.S. Pat. RE 35,386 to Wu et al, having the same assignee as the present disclosure teaches use of a resistivity model to provide a modeled log indicative of the response of a resistivity tool within a selected stratum in a substantially horizontal direction. A directional (e.g., horizontal) well is thereafter drilled wherein resistivity is logged in real time and compared to that of the modeled horizontal resistivity to determine the location of the drill string and thereby the borehole in the substantially horizontal stratum. From this, the direction of drilling can be corrected or adjusted so that the borehole is maintained within the desired stratum. In the present disclosure, resistivity measurements may be used to update the Geomechanical Model, and/or alarms may be triggered when the borehole deviates from the planned trajectory. This may be done if the trajectory approaches a bed boundary. The updating of the Geomechanical Model and/or triggering of alarms may also be done using multicomponent induction resistivity measurements. The use of multicomponent resistivity measurements in reservoir navigation is discussed in U.S. Pat. No. 7,612,566 to Merchant et al, having the same assignee as the present disclosure. The updating of the Geomechanical Model and/or triggering of alarms may be done using formation pore pressure measurements. The use of formation pore pressure measurements is disclosed, for example, in U.S. Pat. No. 7,063,174 to Chemali et al, having the same assignee as the present disclosure U.S. Pat. No. 7,167,006 to Itskovich, having the same assignee as the present disclosure and the contents of which are incorporated herein by reference, teaches the use of transient electromagnetic (TEM) signals for reservoir navigation. The present disclosure may use resistivities determined by TEM methods to update the Geomechanical Model and/or trigger alarms.

Insufficient mud pressure—A warning alarm is triggered when the downhole mud pressure is approaching the predicted pore pressure or collapse pressure. When the Geomechanical Model indicates that the drillbit may be approaching a sand region that may be over-pressured due to hydrocarbon buoyancy and/or centroid effects, this alarm may be triggered before the drillbit enters the overpressured region. A warning alarm may be triggered when the ECD 313 is crosses the warning threshold for the recommended minimum mud weight 301.

Excessive mud pressure—This alarm is designed to sound an alert when there is an increase in the ECD such that there may be an issue with hole cleaning or that induced hydraulic fracturing may occur. This alarm can be triggered when the ECD 313 approaches a warning threshold for the recommended maximum mud weight 303.

Sweep notifications at different points along the wellbore—Sweeps are performed in the borehole to clean it. This is done by increasing the mud pressure. When sweeps are pumped, the downhole pressure can change dramatically. An automated alarm can also be developed for this potential problem. For this, monitoring of the pressure and the ECD may be done at the bit, the top of BHA, at shoes, and at the surface. This particular sweep notification would be derived from the mudlogger. The mudlogger can pinpoint where the sweep is located in the borehole using predicted or measured hole diameters and volume of mud pumped since sweep was pumped. An alarm notifies when the sweep pass certain parts of the wellbore (bit, shoe, . . . ). The ECD management relates changes in ECD in relation to where the sweep is located.

Sweep efficiency gauge—This can be an alarm to warn of the efficiency of the sweep for hole-cleaning purposes. Sweep efficiency could be estimated by the amount the ECD drops to its estimated baseline (clean hole) or simulated ECD from rheological-based hydraulics calculations corrected for temperature, pressure and other effects.

ECD drops—This alarm is triggered when kicks (influx) cause mud pressure to drop below static pressure.

ECD increases—Alarms to warn of ECD trend increases above expected. This could signal insufficient hole-cleaning and/or pack-off events.

Mud cut alarm—Alarm to warn of excessive gas in the mud leading to a decrease in the bottom-hole mud pressure. Mud cut is the measurement of "surface mud weight" and how it is affected by the gas recorded at the surface. In one embodiment of the disclosure, a relationship is made to estimate gas expansion. Alternatively, a static downhole mud weight (pumps off reading) is made and a linear projection is made of the amount of gas cut along the wellbore to a downhole location. The projected downhole value of the gas is used to estimate a value of ECD and an alarm is triggered if a threshold for minimum mud weight is crossed.

Excessive gas alarm—This alarm sounds when there is an excessive amount of measured gas (drill and connection) in the system. Excess gas is defined in terms of changes relative to a background gas level. Excessive gas could lead to a mud cut and the danger for kicks and or collapse. Detection of gas is discussed, for example, in U.S. patent application Ser. No. 12/398,060 (U.S. 20090173150) of DiFoggio, having the same assignee as the present disclosure. An alarm is triggered based on a mud weight estimated by the downhole processor by using the amount of measured gas.

Cavings morphology—This is a manual alarm in which the mud engineer monitors cuttings and cavings and reports the presence (type and volume) of cavings. This includes photos and descriptions and may be manually or automatically entered into the database. This is based on size, shape and rate of cuttings/cavings.

Drilling data—These automated alarms are meant to warn the drillers when the risk of drilling dysfunctions increases. Drilling dysfunctions can cause irreversible (and potentially catastrophic) damage to the rock due to mechanical agitation. Conversely, drilling dynamics may be occurring because of wellbore instability (e.g., hole-enlargement). The measurements made for detecting the risk of drilling dysfunction could include torque and drag, pick-up and slack-off weights, etc. These types of alarms may be available in the real-time displays and, in the present disclosure, are linked-up to the real-time WBI services. U.S. patent application Ser. No. 11/357,322 (U.S. 20060212224) of Jogi, having the same assignee as the present disclosure discloses the use of drilling dynamics measurements to predict formation lithology. The same or similar drilling dynamics measurements can be used to trigger an alarm of an approaching drilling dysfunction in real-time. See also U.S. Pat. No. 6,021,377 to Dubinsky et al., having the same assignee as the present disclosure. As discussed in Jogi, the measurement may include mud motor parameters (e.g., mud motor stator temperature, differential pressure across a mud motor, and fluid flow rate through a mud motor), and measurements of acceleration, vibration, whirl, radial displacement, stick-slip, torque, shock, vibration, strain, stress, bending moment, bit bounce, axial thrust, friction, backward rotation, BHA buckling and radial thrust. Sensors distributed along the drill string can measure physical quantities such as drill string acceleration and strain, internal pressures in the drill string bore, external pressure in the annulus, vibration, temperature, electrical and magnetic field intensities inside the drill string, bore of the drill string. An alarm may be triggered in real-time when any of these parameters is outside the safe region.

Tripping speeds—When tripping speeds become excessive, a warning can be triggered so that speeds can be slowed. When tripping out of the hole, there is a potential for collapse below the drill due to a reduced pressure from suction. When tripping into the hole at excessive speed, hydraulic fracturing may occur due to pressure buildup below the drill. This type of alarm uses a hydraulics model based on formation permeability. In the case of tripping out of a borehole, the hydraulic model estimates the decrease in borehole pressure using the formation permeability below the drillbit and the size of the annulus between the drillbit and the borehole wall: these two factors will determine the inflow of formation fluid into the borehole and the extent of the decrease in borehole pressure below the drillbit. In the case of tripping into a borehole, the hydraulic model estimates the increase in borehole pressure using the formation permeability below the drillbit and the size of the annulus between the drillbit and the borehole wall: these two factors will determine the increase in borehole pressure below the drillbit and the possibility of formation fracture.

Temperature—The temperature alarm is responsive to modeled temperature-induced wellbore instability. An exemplary temperature-hydraulics model for modeling borehole instability is given in Tang et al, (SPE 39505).

Image/caliper observations—Observed hole enlargements and induced hydraulic fractures from image and/or oriented caliper logs are used a an alert. Determination of borehole size and image has been discussed above with reference to Moos '252. The detection of faults and steeply dipping beds can also be included to provide an alarm when a fault is crossed as this could be an indication of a possible change in formation lithology and pore pressure.

Losses/wellbore breathing—This alarm is responsive to observed losses from wellbore breathing and lost circulation observances. Wellbore breathing and lost circulation can be measured at the surface from fluid recovered or lost or be predicted by response of ECD signature. Lost circulation is an indication of excessive ECD. This is also an indication that the Geomechanical Model may have underestimated formation permeability in the porous formations, or may have underestimated the rock strength in at least one formation. This is an indication that ECD should be lowered.

Formation tops—This alarm is triggered when formation top occurs at a different depth than is in the model. For instance, if a sand region comes in structurally higher, then the potential for centroid effects may be increased.

The processing of the measurements made may be done by the surface processor 142, by at least one downhole processor, or at a remote location. The data acquisition may be controlled at least in part by the downhole electronics. Implicit in the control and processing of the data is the use of a computer program on a suitable machine readable-medium that enables the processors to perform the control and processing. The term processor is intended to include devices such as a field programmable gate array (FPGA). The term processor is also intended to include multiple core or multiple processor systems.

What has been described above includes a method of conducting a drilling operation. The method includes: conveying a bottomhole assembly into a borehole on a drilling tubular; making a measurement at least one of: (i) a downhole location, and (ii) a surface location; comparing, in real-time, the at least one measurement with a prediction from a Geomechanical Model; and altering a parameter of the drilling operation based on the comparison.

In the described method, the Geomechanical Model may be a pre-drill Geomechanical Model based on at least one of: (i) surface seismic data, and (ii) well data from a previously drilled borehole. The Geomechanical Model may be an updated Geomechanical Model derived from a pre-drill Geomechanical Model and the at least one measurement made at the at least one of: (i) the downhole location, and (ii) the surface location. The at least one measurement further may include a measurement at the downhole location selected from: (i) a formation permeability, (ii) a formation pore pressure, (iii) a formation top, (iv) a caliper image of the borehole, (v) a resistivity image of the borehole, (vi) a formation resistivity, (vii) a formation acoustic response, and (viii) a formation acoustic image. The parameter of drilling operations that is altered may be selected from: (i) a drilling methodology, (ii) a drilling fluid program, (iii) a casing selection point, and (iv) a direction of drilling. The method may further include providing a signal when the at least one measurement is outside specified limits. The signal may be provided based on at least one of: (i) a downhole mud pressure, (ii) an Equivalent Circulating Density of a mud in the borehole, (iii) a detection of gas in the borehole, (iv) morphology and volume of cuttings and cavings at a surface location, (v) a torque measurement, (vi) a drag measurement, (vii) a pick-up weight, (viii) a slack-off weight, (ix) a mud motor stator temperature, (x) a differential pressure across a mud motor, (xi) fluid flow rate through a mud motor, (xii) a measurement of acceleration, (xiii) a measurement of a vibration, (xiv) a measurement of whirl, (xv) a measurement of radial displacement, (xvi) a measurement of stick-slip, (xvii) a measurement of strain, (xviii) a measurement of stress, (xix) a measurement of bending moment, (xx) a measurement of bit bounce, (xxi) a measurement of axial thrust, friction, (xxii) a measurement of backward rotation, (xxiii) a measurement of BHA buckling, (xxiv) a measurement of radial thrust, (xxv) a catalog of drilling events.

Also described above is an apparatus configured to conduct a drilling operation. The apparatus includes: a bottomhole assembly configured to be conveyed into a borehole on a drilling tubular; at least one sensor configured to make a measurement at least one of: (i) a downhole location, and (ii) a surface location; and at least one processor configured to: (i) compare, in real-time, the at least one measurement with a prediction from a Geomechanical Model, and (ii) alter a parameter of the drilling operation based on the comparison.

In the apparatus described above, the Geomechanical Model may be a pre-drill Geomechanical Model based on at least one of: (i) surface seismic data, and (ii) well data from a previously drilled borehole. The Geomechanical Model may be an updated Geomechanical Model derived from a pre-drill Geomechanical Model and the at least one measurement made at the at least one of: (i) the downhole location, and (ii) the surface location. The at least one measurement may include a measurement made at the downhole location selected from: (i) a formation permeability, (ii) a formation pore pressure, (iii) a formation top, (iv) a caliper image of the borehole, (v) a resistivity image of the borehole, (vi) a formation resistivity, (vii) a formation acoustic response, and (viii) a formation acoustic image. The parameter of drilling operations that is altered by the at least one processor may include: (i) a drilling methodology, (ii) a drilling fluid program, (iii) a casing selection point, and (iv) a direction of drilling. The at least one processor may be further configured to provide a signal when the at least one measurement is outside specified limits. The at least one processor may be further configured to provide the signal based on at least one of: (i) a downhole mud pressure, (ii) an Equivalent Circulating Density of a mud in the borehole, (iii) a detection of gas in the borehole, (iv) morphology and volume of cuttings and cavings at a surface location, (v) a torque measurement, (vi) a drag measurement, (vii) a pick-up weight, (viii) a slack-off weight, (ix) a mud motor stator temperature, (x) a differential pressure across a mud motor, (xi) fluid flow rate through a mud motor, (xii) a measurement of acceleration, (xiii) a measurement of a vibration, (xiv) a measurement of whirl, (xv) a measurement of radial displacement, (xvi) a measurement of stick-slip, (xvii) a measurement of strain, (xviii) a measurement of stress, (xix) a measurement of bending moment, (xx) a measurement of bit bounce, (xxi) a measurement of axial thrust, friction, (xxii) a measurement of backward rotation, (xxiii) a measurement of BHA buckling, (xxiv) a measurement of radial thrust, (xxv) a catalog of drilling events.

Also, described above is a computer-readable medium product having stored thereon instructions that when read by at least one processor enable the at least one processor to perform a method. The method includes: comparing, in real-time, at least one measurement made at least one of: (i) a downhole location, and (ii) a surface location with a prediction from a Geomechanical Model; and altering a parameter of the drilling operation based on the comparison.

The described computer-readable medium may include (i) a ROM, (ii) an EPROM, (iii) an EAROM, (iv) an EEPROMs, (v) a flash memory, (vi) a RAM, (vii) a hard drive, and (viii) an optical disk.

While the foregoing disclosure is directed to the preferred embodiments of the disclosure, various modifications will be apparent to those skilled in the art. It is intended that all variations within the scope and spirit of the appended claims be embraced by the foregoing disclosure.

The invention claimed is:

1. A method of conducting a drilling operation, comprising:

drilling a borehole;

predicting a value of a first parameter relating to the drilling of the borehole using a Geomechanical Model;

estimating a value of a second parameter from measurements taken by a sensor; and using a processor to control the drilling operation by:

updating the Geomechanical Model based at least in part on the estimated value of the second parameter, predicting in real time a second value of the first parameter using the updated Geomechanical Model, and altering a drilling parameter for drilling the borehole based on the predicted second value of the first parameter to reduce a tendency of a drill bit to drift in a direction of a minimum horizontal principal stress.

2. The method of claim 1 wherein the first parameter is a mud window.

3. The method of claim 1 wherein the second parameter is selected from a group consisting of a: (i) formation permeability, (ii) formation pore pressure, (iii) formation top, (iv) caliper image of the borehole, (v) resistivity image of the borehole, (vi) formation resistivity, (vii) formation acoustic response, and (viii) formation acoustic image.

4. The method of claim 1 wherein the geomechanical model is a pre-drill geomechanical model based at least in part on one of: (i) surface seismic data, and (ii) well data from a previously drilled borehole.

5. The method of claim 1 wherein measurements are taken at one of: (i) in the borehole, and (ii) a surface location.

6. The method of claim 1 wherein altering the drilling parameter comprises altering a parameter selected from a group consisting of a: (i) drilling methodology; (ii) drilling fluid program; (iii) casing selection point; and (iv) direction of drilling.

7. The method of claim 1 wherein the measurement taken by the sensor relate to at least one of: (i) downhole mud pressure; (ii) equivalent circulating density of a mud in the borehole; (iii) detection of gas in the borehole; (iv) morphology and volume of cuttings and savings at a surface location; (v) torque; (vi) drag; (vii) pick-up weight; (viii) slack-off weight; (ix) mud motor stator temperature; (x) differential pressure across a mud motor; (xi) fluid flow rate through a mud motor; (xii) acceleration; (xiii) vibration; (xiv) whirl; (xv) radial displacement; (xvi) stick-slip; (xvii) strain; (xviii) stress; (xix) bending moment; (xx) bit bounce; (xxi) axial thrust, friction; (xxii) backward rotation; (xxiii) buckling; (xxiv) radial thrust; and (xxv) drilling event.

8. An apparatus configured to conduct a drilling operation, the apparatus comprising:

a drill string for drilling a borehole;

a bottomhole assembly configured to be conveyed into a borehole on the drill string;

a sensor configured to make a measurement at one of: (i) a downhole location, and (ii) a surface location; and a processor configured to control the drilling operation by:

predicting a value of a first parameter relating to drilling of the borehole using a Geomechanical Model, estimating a value of a second parameter from the measurement taken by the sensor, updating the Geomechanical Model based at least in part on the estimated value of the second parameter, predicting in real time a second value of the first parameter using the updated Geomechanical Model, and altering a drilling parameter for drilling the borehole based on the predicted second value of the first parameter to reduce a tendency of a drill bit to drift in a direction of a minimum horizontal principal stress.

9. The apparatus of claim 8 wherein the first parameter is a mud window.

10. The apparatus of claim 8 wherein the Geomechanical Model further comprises a pre-drill Geomechanical Model based on at least one of: (i) surface seismic data; and (ii) well data from a previously drilled borehole.

11. The apparatus of claim 8 wherein the Geomechanical Model further comprises an updated Geomechanical Model derived from a pre-drill Geomechanical Model and the measurement made at one of: (i) a downhole location; and (ii) a surface location.

12. The apparatus of claim 8 wherein the at least one measurement further comprises a measurement made at a downhole location relating to at least one of: (i) formation permeability; (ii) formation pore pressure; (iii) formation top; (iv) caliper image of the borehole; (v) resistivity image of the borehole; (vi) formation resistivity; (vii) formation acoustic response; and (viii) formation acoustic image.

13. The apparatus of claim 8 wherein the drilling parameter is selected from a group consisting of a: (i) drilling methodology; (ii) drilling fluid program; (iii) casing selection point; and (iv) direction of drilling.

14. The apparatus of claim 8 wherein the processor is further configured to provide a signal when the measurement made by the sensor is outside a selected norm.

15. The apparatus of claim 14 wherein the signal relates to one of: (i) a downhole mud pressure; (ii) an Equivalent Circulating Density of a mud in the borehole; (iii) a detection of gas in the borehole; (iv) morphology and volume of cuttings and cavings; (v) a torque measurement; (vi) a drag measurement; (vii) a pick-up weight; (viii) a slack-off weight; (ix) a mud motor stator temperature; (x) a differential pressure across a mud motor; (xi) fluid flow rate through a mud motor; (xii) a measurement of acceleration; (xiii) a measurement of a vibration; (xiv) a measurement of whirl; (xv) a measurement of radial displacement; (xvi) a measurement of stick-slip; (xvii) a measurement of strain; (xviii) a measurement of stress; (xix) a measurement of bending moment; (xx) a measurement of bit bounce; (xxi) a measurement of axial thrust, friction; (xxii) a measurement of backward rotation; (xxiii) a measurement of BHA buckling; (xxiv) a measurement of radial thrust; and (xxv) a catalog of drilling events.

16. A non-transitory computer-readable medium having stored thereon instructions that when executed by a processor enable the processor to perform a method for drilling a borehole, the method comprising:

predicting a value of a first parameter relating to the drilling of the borehole using a Geomechanical Model;

estimating a value of a second parameter from measurements taken by a sensor; and controlling the drilling operation by:

updating the Geomechanical Model based at least in part on the estimated value of the second parameter, predicting a second value of the first parameter using the updated Geomechanical Model, and altering a drilling parameter for drilling the borehole based on the predicted second value of the first parameter to reduce a tendency of a drill bit to drift in a direction of a minimum horizontal principal stress.

17. The non-transitory computer readable medium of claim 16 wherein the first parameter is a mud window.

18. The non-transitory computer-readable medium of claim 16 wherein the Geomechanical Model comprises a pre-drill Geomechanical Model based on at least one of: (i) surface seismic data, and (ii) well data from a previously drilled borehole.

19. The non-transitory computer-readable medium of claim 16 wherein the measurement made by the sensor comprises a measurement made at a downhole location selected from: (i) a formation permeability, (ii) a formation pore pressure, (iii) a formation top, (iv) a caliper image of the borehole, (v) a resistivity image of the borehole, (vi) a formation resistivity, (vii) a formation acoustic response, and (viii) a formation acoustic image.

20. The non-transitory computer-readable medium of claim 16 wherein the drilling parameter is selected from a group consisting of a: (i) drilling methodology, (ii) drilling fluid program, (iii) casing selection point, and (iv) direction of drilling.

21. A method of conducting a drilling operation, comprising:

conveying a drilling assembly for conducting the drilling operation into a borehole, the drilling assembly including a sensor configured to make a measurement relating to a selected parameter;

making the measurement by the sensor and estimating a value of the selected parameter using the sensor measurement; and using a processor to control the drilling operation by:

predicting a value of the selected parameter using a Geomechanical Model, comparing the estimated value of the selected parameter and the predicted value of the selected parameter, and altering a parameter relating to the drilling operation based at least in part on comparing the estimated value and the predicted value of the selected parameter to reduce a tendency of a drill bit to drift in a direction of a minimum horizontal principal stress.

* * * * *